United States Patent [19]

Pawlik et al.

[11] Patent Number: 4,833,454

[45] Date of Patent: May 23, 1989

[54] DOOR CHIME

[75] Inventors: James P. Pawlik, Greendale; Margaret A. Erdell, Brookfield, both of Wis.

[73] Assignee: Jay Advertising, Inc., Milwaukee, Wis.

[21] Appl. No.: 147,261

[22] Filed: Jan. 22, 1988

[51] Int. Cl.[4] ..... G08B 13/08

[52] U.S. Cl. ..... 340/545; 340/384 E; 340/527; 340/693

[58] Field of Search ..... 340/545, 546, 566, 693, 340/527, 384 E

[56] References Cited

U.S. PATENT DOCUMENTS

| | | | |
|---|---|---|---|
| 4,258,358 | 5/1981 | Lee et al. | 340/384 E |
| 4,435,701 | 3/1984 | Baon | 340/546 |
| 4,772,879 | 9/1988 | Hein | 340/527 |

*Primary Examiner*—Glen R. Swann, III

*Attorney, Agent, or Firm*—Ronald E. Barry

[57] ABSTRACT

An audio signal device for a door mounted advertising display, the device includes a signal unit, a battery connected to said signal unit, the unit including a tone generator, a pulse generator connected to control the tone generator, a timer connected to control the time of operation of the pulse generator, and a motion switch connected to energize the timer in response to the motion of the door, the timer further including a circuit for preventing reactivation of the timer for a predetermined period of time.

9 Claims, 2 Drawing Sheets

DOOR CHIME

BACKGROUND OF THE INVENTION

This invention relates to signaling devices which are used to indicate the opening of a door in a retail establishment. There are many devices which have been used to indicate opening and closing of doors. These include bells, either mounted on the door or positioned to be engaged by the opening motion of the door, switches have also been provided in the door frame which are activated by movement of the door to open or close electrical circuits.

SUMMARY OF THE INVENTION

The door chime according to the present invention is a self-contained, electrically actuated device which forms a part of an advertising display that is adhesively secured to the door. A principal feature of the invention is the provision of a self-contained, audio signal unit which provides a signal whenever the door is moved.

A further feature of the invention is the provision of a predetermined time delay to allow the door to close without a continuous signal.

Another feature of the invention is the provision of a time controlled audio signal that provides a predetermined signal in the time delay interval.

Other principal features and advantages of the invention will become apparent to those skilled in the art upon review of the following detailed description, claims and drawings.

DESCRIPTION OF THE PREFERRED EMBODIMENT

Figure 1:
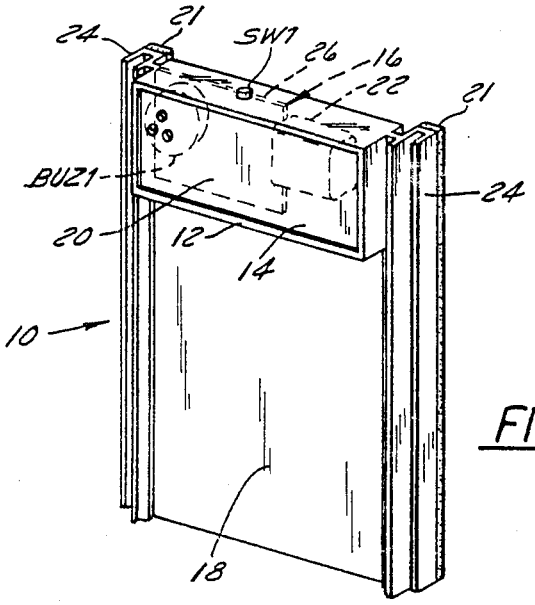
FIG. 1 is perspective view of the advertising display in which the audio signal assembly according to the invention is mounted.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

The advertising display case 10 is shown in our copending design application Ser. No. 07/020,656, filed on Mar. 2, 1987, entitled Door Tone. The display case generally includes a housing 12 having a compartment 14 in the upper end in which the audio signal assembly 16 is mounted. The housing includes a panel 18 on which advertising may be provided and also a panel 20 on the compartment to indicate entry or exit instructions. The case is mounted on the inside of a door by means of adhesive strips 21 provided on the back of the side support members 24. If the case is mounted on a glass door advertising can also be placed on the back of panel 18 and housing 20.

Figure 2:
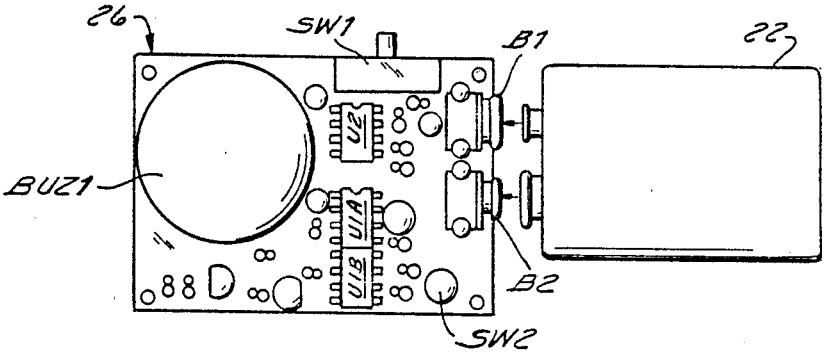
FIG. 2 is a view of the battery and circuit board for the audio signal assembly.

In accordance with the invention, the audio signal assembly 16, as seen in FIG. 2, includes a printed circuit board 26 and a battery 22. The circuit board 26 includes an on and off switch SW1 for activating the signal circuit, a motion switch SW2 which responds to the motion of the door and a piezoelectric audio indicator BUZ1. SW1 is closed to activate the circuit which is then responsive to the motion switch SW2. On movement of the door, SW2 closes to trigger a dual precision monostable multivibrator U1A–U1B (CD4538B National Semi-Conductor). When triggered, the first half of the multivibrator U1A will operate for a fixed time period during which time the circuit ignores further motion inputs. The second half of the multivibrator, U1B, is triggered simultaneously for a time period during which the pulse generator U2 may operate and thus determines the number of tones produced on each activation of the circuit. The pulse generator U2 (LM555 National Semi-Conductor) is a timer configured to generate pulses, generally two output pulse cycles, during the preset time period. The pulses are sent to the piezoelectric audio indicator BUZ1 (KPE-133 Kingstate) to provide two short sound tones.

Figure 3:
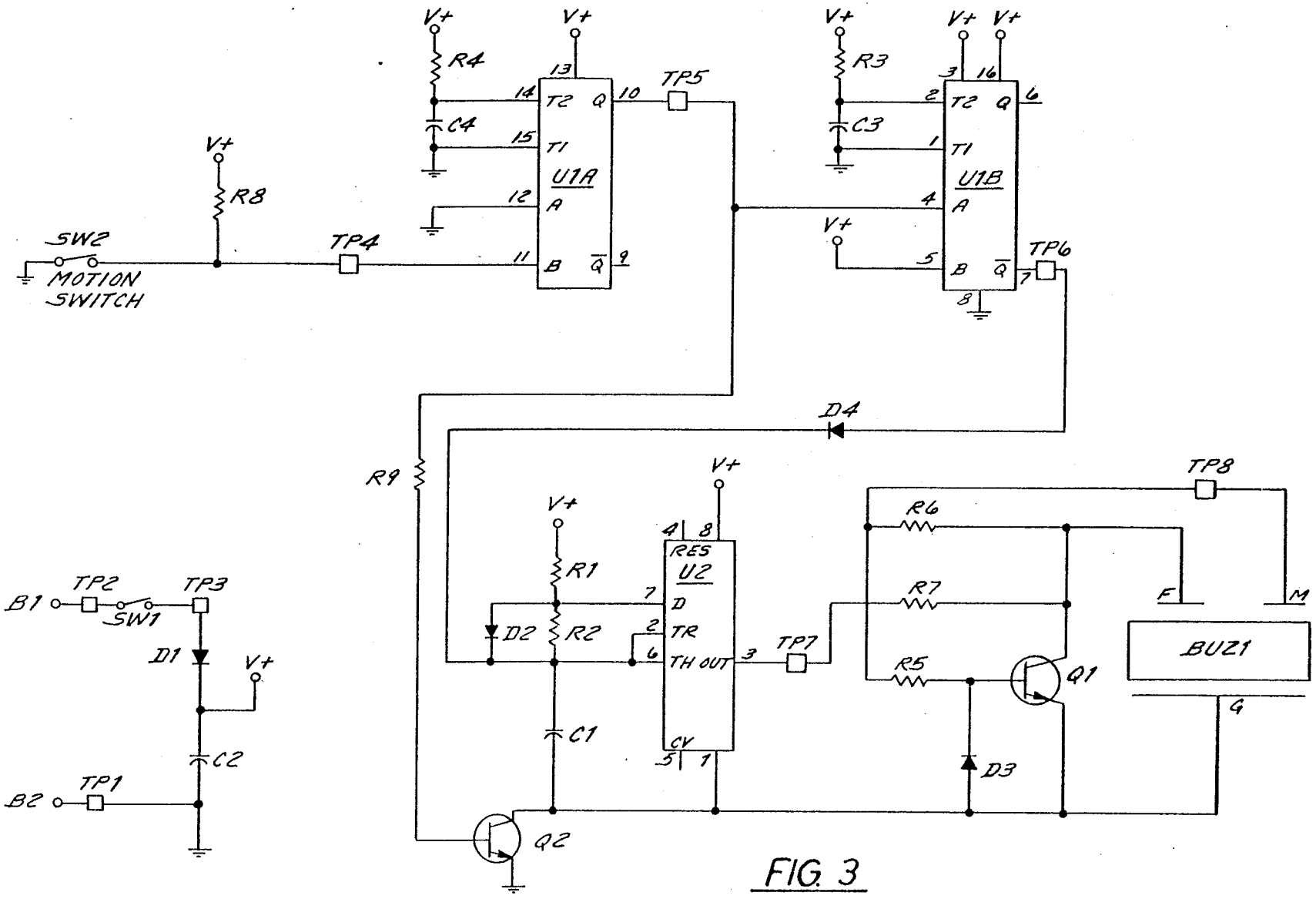
FIG. 3 is a circuit diagram of the printed circuit assembly shown in FIG. 2.

More specifically and referring to FIG. 3, a schematic circuit diagram is shown for the electrical circuit. The circuit is powered by a 9-volt battery 22 which is connected to terminals B1 and B2 as described above. Switch SW1 is provided as a means for interrupting power when the device is not in use. The switch circuit is protected by means of a diode D1 to prevent damage to the circuit if an attempt is made to install the battery in reverse polarity position. Means in the form of a capacitor C2 is provided to support the power supply voltage during short pulses of high current, such as when the tone generator BUZ1 is activated.

The circuit is activated upon movement of the door by means of a motion sensitive switch SW2 which is of the type having a mercury bead positioned in a sealed tube with contacts at one end which are closed by the movement of the bead into the end of the tube. Switch SW2 is held in a horizontal position by locating tabs molded as part of the case 10. Terminal 11 of the first half of the multivibrator U1A is maintained at a voltage V+ by a resistor R8 until the switch SW2 closes in response to motion of the door. Upon closing terminal U1-12 is shorted to common. The first half of the multivibrator U1A is configured to respond to the falling edge of a trigger pulse via terminal 11. When triggered, terminal 10 will go high (logic 1) for a fixed time period equal to the resistance R4 times the capacitor C4, (i.e. 1.5E6 * 10E-6=15 seconds). This establishes the time period during which the circuit ignors further motion of the mercury bead in the switch SW2.

Means is provided to interrupt power to all portions of the circuit following the first half of the multivibrator U1A in order to minimize battery drain when the circuit is in the standby mode. This is accomplished by means of a semi-conductor Q2 which is driven off of terminal U1A-10 via resistence R9. The semi-conductor Q2 provides a path to common for all circuits associated with timer U2 and semi-conductor Q1.

The time period during which the pulse generator U2 may operate is determined by means of the second half of the multivibrator U1B. In this regard the multivibrator U1B is configured to respond to the leading edge of a trigger pulse via terminal 4 from multivibrator U1A terminal 10. Multivibrator U1B terminal 7 goes low (logic 0) for a time period determined by resistence R3 times capacity C3 (470E3 * 1E−6=0.47 seconds). During this period of time two tones from tone generator BUZ1 are initiated.

The pulse generator U2 is a timer configured to generate pulses. The pulse generator is enabled to cycle whenever multivibrator U1B-7 is low (logic 0) and is disabled, via diode D4, whenever U1B-7 is high (logic 1). The pulse generator U2 can, therefore, produce pulses during the 0.47 second period of the multivibrator U1B operation. Although it has been described as producing two output pulse cycles in this time period, it should be noted that this can be adjusted according to the requirements of the user.

The tone generator BUZ1 is a piezoelectric audio indicator of the externally excited type. The tone generator BUZ1 is driven by a semi-conductor Q1 which together comprise an oscillator operating at 3,600 hertz (cycles per second). This circuit is enabled to operate whenever the output of pulse generator U2 (terminal 3) is high (logic 1). This circuit is disabled whenever pulse generator U2 (terminal 3) is low (logic 0) via resistence R7. Diode D3 is provided to prevent high voltage spikes produced by the tone generator BUZ1 from exceeding the reverse break down voltage of the semiconductor Q1's base-emmitter function.

The embodiment of the invention is which an exclusive or privilege is claimed, as defined as follows:

1. A self-contained door mounted signal device comprising a housing having an enclosed chamber and an advertising panel on the front and back of said housing,
   a printed circuit board mounted in said chamber, said board including,
   means for sensing the motion of the door for generating a signal,
   timing means responsive to the signal from said sensing means for establishing a time delay before responding to a second signal from said sensing means,
   generating means responsive to the signal from said sensing means for generating a pulse.
   emitting means responsive to the pulse from said generating means for emmiting a tone signal,
   circuit means for interconnecting said sensing means, said timing means, said pulsing means and said tone emitting means,
   and a battery mounted in said chamber and operatively connected to said circuit means for energizing said circuit.

2. The signal device according to claim 1 wherein said timing means and said generating means comprises a dual monostable multivibrator.

3. The signal device according to claim 1 or 2 wherein said sensing means comprises a mercury switch.

4. The signal device according to claim 1 or 2 wherein said generating means comprises a pulse timer.

5. The signal device according to claim 1 or 2 wherein said tone emitting means comprises a piezoelectric audio indicator.

6. The device according to claim 3 wherein said generating means comprises a pulse timer.

7. The device according to claim 3 wherein said tone emitting means comprises a piezo electric audio indicator.

8. The signal device according to claim 7 wherein said timing means comprises a dual mono stable multivilerator, said sensing means comprises a mercury switch, and said generating means comprises a pulse timer and said emitting means comprises a piezo electric audio indicator.

9. An audio signal device for a door mounted advertising display, said display comprising:
   a housing,
   means for securing said housing to a door, a chamber in said housing,
   and said device comprising a battery operated audio signal unit positioned in said chamber,
   said unit including a motion switch responsive to movement of the door to activate said unit,
   timing means connected to respond to movements of said motion switch to activate said unit for a preset time period before responding to further motion of the door,
   a pulse generator connected to respond to said timing means to generate a preset number of pulses,
   and a tone generator responsive to said pulse generator pulses to provide an audio signal in response to each pulse.

* * * * *